US006064154A

United States Patent [19]

Crouch et al.

[11] Patent Number: 6,064,154

[45] Date of Patent: May 16, 2000

[54] MAGNETRON TUNING USING PLASMAS

[75] Inventors: David D. Crouch, Corona; Joseph Santoru, Agoura Hills; Robin J. Harvey, Thousand Oaks, all of Calif.

[73] Assignee: Raytheon Company, Lexington, Mass.

[21] Appl. No.: 09/095,166

[22] Filed: Jun. 10, 1998

[51] Int. Cl.[7] ..... H01J 23/20; H01J 25/587

[52] U.S. Cl. ..... 315/39.57; 331/90

[58] Field of Search ..... 315/39.55, 39.57; 331/90

[56] References Cited

U.S. PATENT DOCUMENTS 4,282,499 8/1981 DeFonzo ..... 333/231

FOREIGN PATENT DOCUMENTS

WO 92/20088 11/1992 WIPO ..... 315/39.55

*Primary Examiner*—Justin P. Bettendorf

*Attorney, Agent, or Firm*—David W. Collins; Andrew J. Rudd; Glenn H. Lenzen, Jr.

[57] ABSTRACT

Improved magnetron oscillators that controllably form a plasma within each of its resonant cavities to rapidly change the resonant frequency of each cavity. The present invention also provides for frequency tuning methods for use with magnetron oscillators. The plasma is controllably formed in one or more subcells of each resonant cavity in a manner that alters the electromagnetic field within each cavity. Preferably, a magnetized collisional plasma is controlled to rapidly change the resonant frequency of each cavity. However, many types of plasmas may be used to implement the present invention. Controlling formation of the plasma within each cavity tunes the magnetron oscillator on a submillisecond time scale.

12 Claims, 1 Drawing Sheet

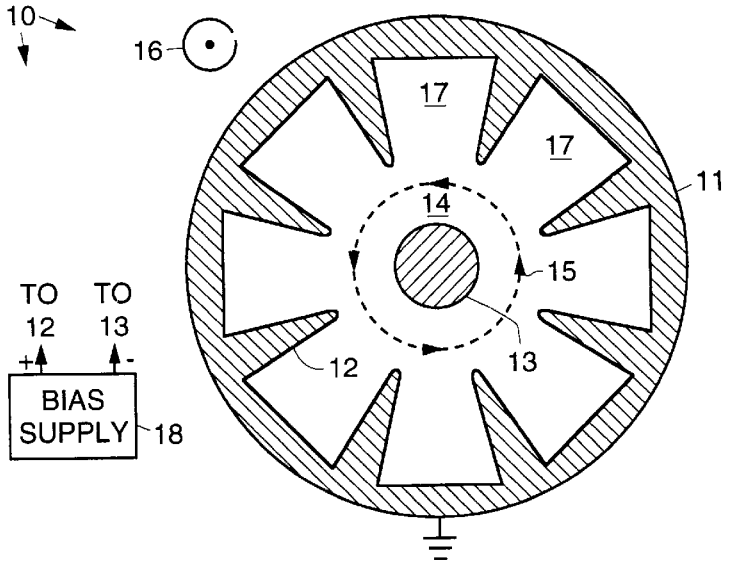
Fig. 1
(PRIOR ART)
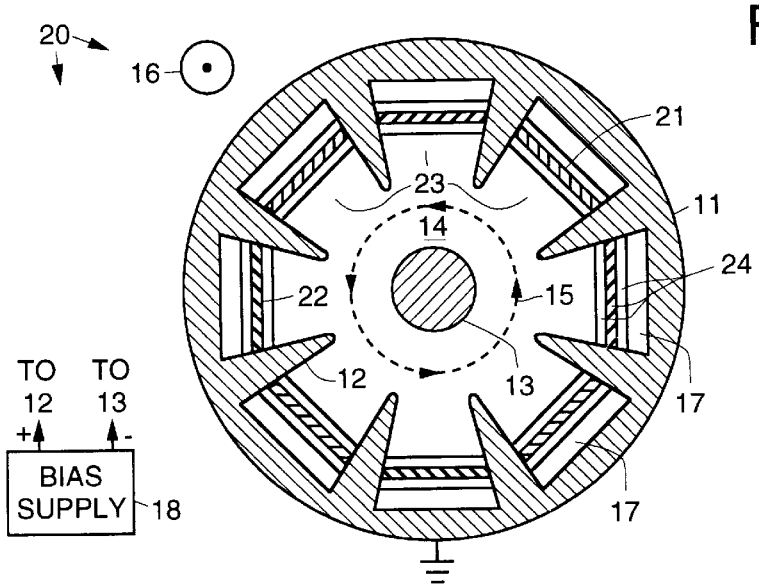
Fig. 2
Fig. 3
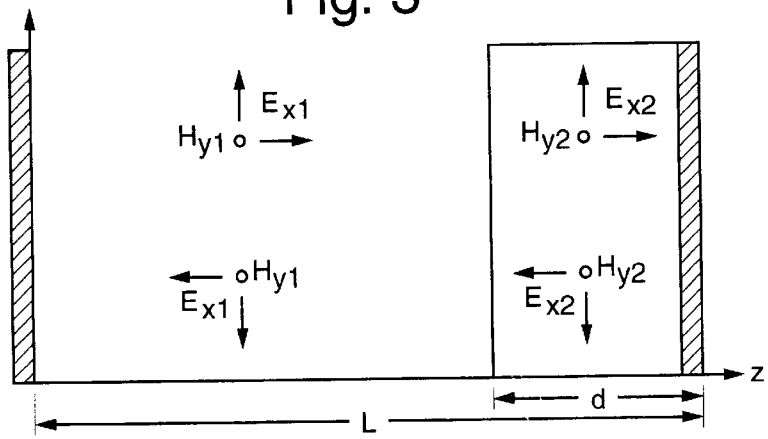

MAGNETRON TUNING USING PLASMAS

BACKGROUND

The present invention relates generally to high power magnetron oscillators and more particularly, to improved magnetron oscillators that are tuned using plasmas, and frequency tuning methods for use with magnetron oscillators.

High-power magnetrons are efficient generators of microwave power. They convert the kinetic energy from an electron beam into microwave- or millimeter-wave energy within a resonant cavity. The oscillation frequency is determined by the cavity, electron-beam voltage and current, and the externally applied magnetic field.

The high efficiency of magnetrons make them an attractive RF source for use in many applications; CW magnetrons have demonstrated efficiencies in excess of 80%. As an oscillator, however, the magnetron is inherently a narrow-band device. While mechanically-tuned magnetrons are available, they suffer from several drawbacks. The maximum tuning rate is limited by the inertia of the tuning mechanism, whose moving parts penetrate the vacuum envelope of the magnetron, thus reducing the reliability of the magnetron.

The oscillation frequency of a tunable magnetron is varied by changing the resonant frequency of its resonant structure. In a mechanically-tuned magnetron this is achieved by mechanically altering the geometry of the resonant structure. This involves mechanically changing the dimensions of the cavity, with corresponding changes to beam voltage and magnetic field as needed, which changes the oscillation frequency of the magnetron. Mechanical tuning is relatively slow and requires a movable vacuum element so that the high-vacuum integrity of the tube can be maintained.

Accordingly, it is an objective of the present invention to provide for improved magnetron oscillators that may be rapidly tuned. It is another objective of the present invention to provide for improved magnetron oscillators that are tuned using plasmas. It is a further objective of the present invention to provide for frequency turning methods for use with magnetron oscillators.

SUMMARY OF THE INVENTION

To accomplish the above and other objectives, the present invention provides for an improved magnetron oscillator that employs a controllable means for rapidly changing the resonant frequencies of its cavities. The present invention also provides for frequency tuning methods for use with magnetron oscillators. The present invention forms a plasma in the cavities of the magnetron oscillator which is controlled to alter the electromagnetic field within the cavities. In a preferred embodiment, the present invention uses a magnetized collisional plasma within the cavities that is controlled to rapidly change the resonant frequency of the cavities. However, various types of plasmas may be used to implement the present invention. Controlling formation of the plasma within the cavity tunes the magnetron oscillator on a submillisecond time scale (i.e., on a pulse-to-pulse, or intra-pulse basis).

More specifically, one embodiment of the magnetron oscillator comprises a magnetron tube having an anode with a plurality of inwardly projecting vanes and a central cathode. Cavities are formed that are bounded by gaps between ends of the vanes, the vanes themselves, and the adjacent wall of the anode. A bias voltage source for supplying a bias voltage between the anode and central cathode is used to create a DC electric field therebetween. A magnet (a permanent magnet or an electromagnet) is used to apply a magnetic field along an axial direction of the magnetron tube. Apparatus is provided that controllably generates a plasma in one or more subcells within each of the cavities to tune the oscillating frequency of the magnetron oscillator. The pattern of plasma-containing subcells in each cavity is the same and each cavity has the same resonant frequency as all other cavities at all times (within some tolerance).

An exemplary method in accordance with the present invention which may be used with any magnetron oscillator forms a plasma within one or more selected subcells in each cavity to alter the electromagnetic field within each cavity to tune the oscillation frequency of the magnetron oscillator.

In contrast to the conventional technique discussed in the Background section, the present invention enables very rapid tuning by introducing a plasma in selected regions within each cavity, thereby changing their electromagnetic properties and therefore their resonant frequencies. Experiments performed at the assignee of the present invention demonstrate that high-density plasmas may be generated within a few micro-seconds, and that these plasmas may be extinguished on a millisecond or faster time scale. The present invention thus provides a high-efficiency rapidly-tunable source of high-power RF radiation. The present invention may be advantageously used in microwave and millimeter wave radar systems, and the like.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a cross sectional view of a basic idealized conventional magnetron oscillator;

FIG. 2 illustrates a magnetron oscillator employing an improved plasma tuning approach in accordance with the principles of the present invention; and FIG. 3 illustrates a one-dimensional Fabry-Perot microwave cavity used to discuss operation of the present invention.

DETAILED DESCRIPTION

The present invention provides for a new approach to rapidly tune a magnetron oscillator. Magnetron oscillators are well-known high-power microwave oscillator tubes that convert electron-beam kinetic energy into microwave energy. Detailed calculations and analysis regarding use of plasmas to achieve cavity tuning has been performed by the present inventors and is summarized below. A preferred embodiment of the magnetron oscillator uses a magnetized collisional plasma in the cavity to alter its resonant frequency while maintaining an adequate Q, or quality factor, for the cavity. The tuning approach of the present invention improves the tuning response of magnetron oscillators in which it is employed.

Referring to the drawing figures, FIG. 1 is a cross sectional view of a basic idealized conventional magnetron oscillator 10. This oscillator 10 includes a housing 11 or tube 11 comprising an anode 11 that has a plurality of inwardly protruding vanes 12 that point toward a central cathode 13. A plurality of resonant cavities 17 are formed by the walls of the inwardly protruding vanes 12 and the adjacent wall of the anode 11. A DC electric field is created between the cathode 13 and the anode 11 by applying an appropriate bias voltage therebetween that is supplied by a bias voltage source 18. A magnet is used to apply an external magnetic field 16 as shown by the encircled dot in FIG. 1 in an axial direction generally aligned along the axis of the oscillator 10.

An electron beam 15 comprising electrons emitted from the cathode 13 orbit in an interaction space 14 or region 14 between the cathode 13 and vanes 12 of the anode 11 as they move under the influence of E×B forces created by perpendicular electric and magnetic fields. Electron kinetic energy is transformed into microwave energy when the electron beam 15 is resonant with the cavities 17. This effect is discussed in "High-Power Microwave Sources", edited by V. L. Granatstein and I. Alexeff, Artech House, Boston. Mass., 1987. The output frequency of the microwave energy is controlled by the dimensions of the cavities 17, the cathode 13 to anode 11 bias voltage, and the intensity of the applied magnetic field 16.

In contrast to the conventional magnetron oscillator 10, and with reference to FIG. 2, the present invention comprises a magnetron oscillator 20 that uses a plasma 21 to alter the resonant frequencies of its cavities 17. The structure of the present magnetron oscillator 20 is substantially similar to the conventional magnetron oscillator 10 described above with reference to FIG. 1. The present magnetron oscillator 20 comprises an anode 11 having a plurality of inwardly protruding vanes 12 and a central cathode 13. A DC electric field is supplied between the cathode 13 and the anode 11 using a bias voltage source 18. An external magnetic field 16 is impressed along an axial direction generally aligned with the axis of the magnetron oscillator 10.

In accordance with the present invention, apparatus is provided that generates plasma 21 in one or more subcells 24 of each cavity 17 of the magnetron oscillator 20. The subcells 24 have physical barriers between them to contain the gas from which the plasma is formed and to prevent plasma from leaving the subcells 24. A variety of different techniques for forming the plasma 21 may be used. However, it is to be understood that the present invention contemplates the use of any technique that may be used to form a plasma 21 within a cavity 17 which changes the effective volume of the cavity 17 to change the resonant frequency of the cavity 17. These techniques are discussed in more detail below.

One specific way to create the plasma 21 is by using a wire-ion plasma (WIP) discharge in a gas-filled subcell 24 within each of the cavities 17. This method is disclosed in U.S. Pat. No. 3,949,260 entitled "Continuous Ionization Injector for Low-Pressure Gas Discharge Device", assigned to the assignee of the present invention. The contents of U.S. Pat. No. 3,949,260 are incorporated herein by reference in its entirety.

To create such a discharge, a high voltage is applied between a WIP wire that protrudes into the gas-filled subcell 24 and the vanes 12, which are at ground potential. Free electrons in the gas and electrons ejected by the vanes 12 are accelerated towards the WIP wire, during which time they collide with neutral gas atoms, some of which are ionized. Electrons resulting from ionizing collisions also accelerate towards the WIP wire, while the ions accelerate towards the vanes 12. Both electrons and ions undergo ionizing collisions until they are collected by the WIP wire and the vanes 12 respectively. Each electron has a nonzero velocity in a direction perpendicular to its velocity towards the wire due to its thermal motion. This perpendicular component of the velocity causes most of the electrons to miss the WIP wire on the first pass. Those electrons that are not collected on the first pass orbit the WIP wire one or more times, undergoing further collision, creating more electron-ion pairs and further increasing the density of the plasma 21. The final plasma density is determined by the gas pressure in the subcell 24 and by the voltage $V_{WIP}$ applied between the WIP wire and the vanes 12. While a single WIP wire may be sufficient to create a plasma 21 of the required density, each gas-filled subcell 24 may be equipped with multiple WIP wires, if necessary.

The present invention may use either a high-density plasma 21 in which the plasma frequency is so high that the microwaves are reflected by the plasma 21, or a low-density plasma 21 in which the dielectric properties of the plasma 21 change the effective volume of the cavity 17. Detailed simulations performed using electromagnetic codes (e.g., HFSS) may be used to determine the optimum plasma density, shape and volume.

With regard to the high-density plasma 21, the permittivity, $\epsilon_p$, of an unmagnetized collisionless plasma is given by the equation $$\varepsilon_p = 1 - \frac{\omega_p^2}{\omega^2}$$

where $\omega_p$ is the angular plasma frequency (proportional to the square root of the plasma density) and $\omega$ is the angular microwave frequency. For the purposes of the present invention, a high-density plasma 21 is defined as one having $\omega_p > \omega$. In this case, $\epsilon_p$ is negative, and as the plasma density increases, the plasma 21 behaves more and more like a metallic conductor in that it begins to exclude the electric field from the plasma 21, with the tangential component of the electric field tending to zero at the "surface" of the plasma 21 when $\omega_p >> \omega$.

When the density of the plasma 21 is sufficiently high, the plasma 21 may be used in place of mechanically-actuated metallic rods or walls to change the geometry of the cavity 17. One of many possible implementations of a plasma-based tuning mechanism is shown schematically in FIG. 2, where the volume of each cavity 17 is modified by a plasma 21 enclosed within a number of discrete cells 23 formed by the outer anode 11, walls of the vanes 12 within the cavity 17, and barriers between neighboring subcells 24. In this configuration, each plasma 21 forms a "surface" 22 that acts as a sliding conducting wall whose position affects the oscillation frequency of the cavity 17. The conducting wall (surface 22) is moved discretely by creating a plasma 21 only in selected subcells 24 and not in others, resulting is discrete frequency changes. An approach that allows continuous tuning is to fill a single subcell 24 with plasma 21 and then change the frequency by controlling the density of the plasma 21 in that subcell 24.

With regard to the low-density plasma 21, for the purposes of the present invention, a low-density plasma 21 is defined as one having $\omega_p < \omega$. A low-density plasma 21 behaves like a dielectric material having $0 \leqq \epsilon_p < 1$. Its presence changes the resonant frequency of the cavity 17. The effect of the plasma 21 on the oscillating electromagnetic field is fundamentally different than the effect of the high-density plasma 21 in that a low-density plasma 21 does not exclude the field from the plasma 21 even when $\epsilon_p = 0$.

A tuner or controller for altering the resonant frequency of the cavity 17 when using a low-density plasma 21 may be readily configured in the manner discussed above for the high-density plasma 21. In addition, many other plasma-generation approaches may be used in implementing the present invention, including plasma arcs, ultraviolet (UV) photoionization, and WIP (Wire-Ion-Plasma) discharges, for example, such as is disclosed in U.S. Pat. No. 5,663,694, issued Sep. 2, 1997, entitled "Triggered-Plasma Microwave Switch and Method", for example, which is assigned to the assignee of the present invention. Controlling the parameters associated with the plasma 21 to control the resonant frequency of the cavity 17 using the techniques discussed herein are readily understood by those skilled in the art.

For example, because the resonant frequency of the cavity 17 is a function of the plasma density, the resonant frequency can be continuously tuned by varying the plasma density, $n_p$. This may be accomplished by creating the plasma 21 using UV photoexcitation. By varying the intensity of the incident UV radiation, the number of photoexcitations per unit volume may be controlled, thus controlling the plasma density. Existing sources of UV radiation include lasers and spark gaps.

Another approach illustrated in FIG. 2 involves maintaining a constant plasma density while varying the volume occupied by the plasma 21. The plasma 21 is contained in a number of subcells 24 whose number depend on the desired degree of tuning accuracy. If the subcells 24 are numbered from 1 to N, with subcell number 1 adjacent to the outer wall of the cavity 17, then tuning over a frequency range can be realized by sequentially creating plasma 21 in subcell number 1 to subcell number N. With no plasma 21 present in any of the subcells 24, the resonant frequency of the cavity 17 is equal to the unloaded value. Intermediate tuning is obtained with plasma filling some of the subcells 24, and the maximum frequency excursion from the unloaded value is realized with plasma filling all of the subcells 24. If the plasma density is very high, then the plasma 21 behaves like a good conductor, and sequentially filling the subcells 24 with plasma 21 has the same effect on the resonant frequency as moving one wall of the cavity towards the cathode 13. The same effect, but to a lesser degree, is obtained for plasmas 21 having lower density.

To more fully understand the present invention, and for the purposes of completeness, presented below is a discussion of the electromagnetic theory relating to the present invention. Reference is made to FIG. 3 for this discussion, which illustrates a one-dimensional Fabry-Perot microwave cavity of length L loaded at one end with a plasma slab of thickness d. Tuning with an unmagnetized plasma 21 will first be discussed. As a simple example of a plasma-loaded RF structure, consider a one-dimensional cavity having two parallel, perfectly conducting walls a distance L apart, with a "slab" of plasma 21 having thickness d and plasma density $n_p$ loading the one end of the cavity. If the plasma 21 is collisionless and unmagnetized, the plasma 21 has an effective dielectric constant of $$\varepsilon_R = 1 - \frac{\omega_p^2}{\omega^2}, \tag{1}$$

where $$\omega_p^2 = \frac{n_p e^2}{\varepsilon_0 m_e} \tag{2}$$

is the plasma frequency, and $n_p$ is the plasma density.

In the one-dimensional cavity, plane waves having non-zero values of $E_x$ and $H_y$ bounce back and forth between the two perfectly conducting walls. Reflections will also occur at the vacuum-plasma interface. The boundary conditions on the electric and magnetic fields are $E_x=0$ at z=0, $E_x=0$ at z=L, $E_x$ is continuous across the vacuum-plasma boundary at z=L−d, and $H_y$ is continuous across the vacuum-plasma boundary at z=L−d.

The nature of the field solutions depend on whether the angular RF frequency is greater than or less than the plasma frequency. By solving Maxwell's equations separately in regions without and with the plasma 21 and applying the boundary conditions, the following solution is generated $$E_x(z) = \begin{cases} A_0 \sin k_1 z & z < L-d, \\ \begin{cases} A_0 \dfrac{\sin k_1(L-d)}{\sin k_2 d} \sin k_2(L-z), & \omega > \omega_p \\ A_0 \dfrac{\sin k_1(L-d)}{\sinh k_2(L-d)} \sinh k_2(L-z), & \omega < \omega_p \end{cases}, & z > L-d \end{cases} \tag{3a}$$

$$H_y(z) = \begin{cases} \dfrac{A_0}{\eta_1} \cos k_1 z & z < L-d, \\ \begin{cases} -\dfrac{A_0}{\eta_1}\sqrt{\varepsilon_R}\, \dfrac{\sin k_1(L-d)}{\sin k_2 d} \cos k_2(L-z), & \omega > \omega_p \\ -\dfrac{A_0}{\eta_1}\sqrt{-\varepsilon_R}\, \dfrac{\sin k_1(L-d)}{\sinh k_2 d} \cosh k_2(L-z), & \omega < \omega_p \end{cases} & z > L-d. \end{cases} \tag{3b}$$

where $$k_1 = \frac{\omega}{c}, \tag{3c}$$

$$k_2 = \begin{cases} \dfrac{\omega\sqrt{\varepsilon_R}}{c}, & \omega > \omega_p, \\ \dfrac{\omega\sqrt{-\varepsilon_R}}{c}, & \omega < \omega_p, \end{cases}$$

$$\eta_1 = \sqrt{\frac{\mu_0}{\varepsilon_0}}.$$

In order for Equations (3) to represent a self-consistent solution, the resonant frequency $f=\omega/2\pi$ must satisfy $$\sqrt{\varepsilon_R}\, \frac{\tan\left[\frac{\omega}{c}(L-d)\right]}{\tan\left[\frac{\omega}{c}\sqrt{\varepsilon_R}\, d\right]} + 1 = 0,\ \varepsilon_R > 0\ (\omega > \omega_p), \tag{4a}$$

$$\sqrt{-\varepsilon_R}\, \frac{\tan\left[\frac{\omega}{c}(L-d)\right]}{\tanh\left[\sqrt{-\varepsilon_R}\, \frac{\omega}{c} d\right]} + 1 = 0,\ \varepsilon_R < 0\ (\omega < \omega_p). \tag{4b}$$

When the cavity is empty, the lowest-order resonance occurs when $L=\lambda/2$, so that $f=c/(2L)$. A one-dimensional cavity having a length of 20 cm is then resonant at a frequency of 749 MHz. The presence of the slab of plasma 21 changes the resonant frequency.

The resonant frequency can be changed by more than 25% by loading the cavity with a plasma 21 whose density can be varied from zero to $3\times10^{11}$ cm$^{-3}$. Two regimes of operation exist. At low densities for which $\omega>\omega_p$, the plasma 21 behaves like a dielectric having a relative permittivity of less than unity, while for high densities $\omega<\omega_p$ the plasma 21 has a negative permittivity and waves of frequency $\omega$ are cut off within the plasma 21. For a cavity having L=20 cm and d=5 cm, the resonant frequency coincides with the plasma frequency $\omega_p$ at a critical plasma density of approximately $n_{pc}=7.55\times10^9$ cm$^{-3}$, at which point $\epsilon_R\approx0$. If $\omega>\omega_p$, the plasma 21 has little effect on the electric field, but a profound effect on the magnetic field. For any value of $n_p$, the tangential components of the electric and magnetic fields, $E_x$ and $H_y$, respectively, are required to be continuous across the plasma boundary. In this one-dimensional case, Maxwell's equations reduce to $$\frac{dE_x}{dz} = -i\omega\mu H_y \Rightarrow H_y = \frac{i}{\omega\mu}\frac{dE_x}{dz}, \qquad (5)$$

$$\frac{dH_y}{dz} = -i\omega\varepsilon E_x \Rightarrow E_x = \frac{i}{\omega\varepsilon}\frac{dH_y}{dz}.$$

The requirement that $H_y$ be continuous across the boundary forces $dE_x/dz$ to be continuous as well, since the permeability $\mu=\mu_0$ on both sides of the boundary. An analogous argument does not hold true for the magnetic field, for while the continuity of $E_x$ requires that $\epsilon^{-1}dH_y/dz$ be continuous across the boundary, $\epsilon$ is not continuous due to the presence of the plasma 21; therefore, $dH_y/dz$ is not continuous.

The maximum effect on the resonant frequency by a low-density plasma 21 occurs when the relative permittivity is nearly zero. The resulting change in the resonant frequency of the loaded cavity with respect to the empty cavity is 4.2% when L=20 cm and d=5 cm. The tuning range can be increased by increasing the size of the slab of plasma 21.

For such a cavity, the plasma 21 has a negative permittivity for plasma densities greater than the critical density $n_{pc}=7.55\times10^9$ cm$^{-3}$. If the cavity is loaded by a relatively high density plasma 21, one having a density of $1.0\times10^{11}$ cm$^{-3}$, the presence of the plasma 21 seriously perturbs both the electric and magnetic fields in the plasma 21. In an extreme case, one for which the cavity is loaded by a very high-density plasma 21, one having $n_p=1.0\times10^{15}$ cm$^{-3}$, the plasma 21 behaves very much like a good conductor, almost completely excluding the electric and magnetic fields from the plasma 21.

If a fixed fraction of the volume of the cavity is delegated to the plasma 21, a much higher degree of tuning can be achieved using a high-density plasma 21 than can be obtained using a low-density "dielectric" plasma 21. A tuning range of nearly 20% can be achieved with a plasma 21 having a density of only $1.0\times10^{11}$ cm$^{-3}$, which can be easily achieved. However, a significantly higher plasma density is required. In the high-density regime, collisions between electrons and neutral gas particles lead to RF losses, which are to be avoided.

Tuning with magnetized plasmas 21 will now be discussed. An axial magnetic field is essential to the operation of the magnetron oscillator 20. The properties of the plasma 21 are affected by the presence of a magnetic field, and the effect of a magnetized slab of plasma 21 on the resonance frequency of the cavity is discussed.

The effective permittivity of a collisionless magnetized plasma 21 in which the electric field is perpendicular to the DC magnetic field is $$\varepsilon_R = 1 - \frac{\omega_p^2}{\omega^2}\omega^2 - \frac{\omega_p^2}{\omega^2 - \omega_p^2 - \omega_c^2}, \qquad (6)$$

where $$\omega_c = \frac{eB}{m_e} \qquad (7)$$

is the angular electron cyclotron frequency, and B is the magnetic flux density. The field solution and the resonant frequency are determined by Equations (3) and (4), respectively; however, Equation (6) is used to determine $\epsilon_R$. The resonant frequency decreases as the magnetic flux density increases. While the magnetic flux density in the interaction region of a magnetron may be several thousand Gauss, the magnetic field around the periphery (where the plasma 21 is located) is significantly less, perhaps only a few hundred gauss. Even if the flux density of the plasma 21 in a cell 23 is as high as 1000 Gauss, the tuning range in this case is reduced from 20% to 16%, which is still a significant tuning range. Careful design of the magnetron's magnetic-field system can minimize the flux passing through the plasma 21, thus minimizing the reduction in tuning due to the magnetic field.

Tuning with a collisional plasma 21 will now be discussed. The fraction of ionized atoms in all but the highest-temperature plasmas 21 is very small, so that the most frequently-occurring collisions are between electrons and neutral atoms. An effective collision frequency for electron-neutral collisions may be defined as $$\nu_{eff} = \frac{8}{3\sqrt{\pi}} N\left(\frac{m_e}{2k_B T_e}\right)^{5/2} \int_0^\infty \upsilon^5 Q^{(m)}(\upsilon)\exp\left(-\frac{m_e\upsilon^2}{2k_B T_e}\right)d\upsilon, \qquad (8)$$

where N is the density of neutral gas atoms, $T_e$ is the electron temperature, and $Q^{(m)}(v)$ is the velocity-dependent momentum-transfer cross section. Itikawa in Phys. Fluids 16, 831 (1973), has compiled much of the available experimental data on momentum-transfer cross sections, and used Equation (8) to calculate collision frequencies for a number of gases. For example, for argon gas at standard temperature and pressure ($N=2.7\times10^{19}$ cm$^{-3}$) and an electron temperature of 5000 K, the effective collision frequency is 260 GHz. A plasma density of approximately $10^{11}$ cm$^{-3}$ is required to obtain an adequate tuning range. If the gas pressure is 1 atmosphere, this plasma density corresponds to a fractional ionization of $3.7\times10^{-9}$. A higher fractional ionization on the order of $2\times10^{-5}$ can be achieved, however, allowing the gas pressure to be reduced to $1.85\times10^{-4}$ atmospheres, which in turn reduces the collision frequency to 50 MHz.

The effective permittivity and conductivity of a collisional, magnetized plasma 21 having a collision frequency of $v_c$, are given by $$\varepsilon = 1 - \frac{\omega_p^2[(\omega^2-\omega_p^2)(\omega^2-\omega_p^2-\omega_c^2)+v_c^2\omega^2]}{\omega^2(\omega^2-\omega_p^2-\omega_c^2-v_c^2)^2+v_c^2(2\omega^2-\omega_p^2)^2}, \qquad (11)$$

$$\sigma = \varepsilon_0\frac{v_c\omega_p^2[\omega_p^4+\omega^2(\omega^2-2\omega_p^2+\omega_c^2+v_c^2)]}{\omega^2(\omega^2-\omega_p^2-\omega_c^2-v_c^2)^2+v_c^2(2\omega^2-\omega_p^2)^2}.$$

With a non-zero value of $\sigma$, the propagation constant within the plasma 21 will always be complex. If an effective, complex relative permittivity is defined by $$\varepsilon_c \equiv \varepsilon' - i\varepsilon'' = \varepsilon - i\frac{\sigma}{\omega\varepsilon_0}, \qquad (12)$$

then the real and imaginary parts of the complex propagation constant are $$k_R \equiv k_0 n_R = k_0\left\{\frac{\varepsilon'}{2} + \sqrt{\left(\frac{\varepsilon'}{2}\right)^2 + \varepsilon''^2}\right\}^{\frac{1}{2}}, \qquad (13)$$

-continued $$k_I \equiv k_0 n_I = k_0 \left\{ \frac{\varepsilon'}{2} - \sqrt{\left(\frac{\varepsilon'}{2}\right)^2 + \varepsilon''^2} \right\}^{\frac{1}{2}},$$

where $n_R$ and $n_1$ are the real and imaginary parts of the complex index of refraction.

The effect of collisions on the resonant frequency and quality factor Q of a plasma-loaded cavity will now be discussed. Because cavities having finite values of Q are used, the end reflectors of the cavity, formerly assumed to be perfect conductors, are replaced by partially-reflecting, partially transmitting mirrors. The power reflection coefficient of such a cavity, when empty, is $$R_{cav} = \frac{4R\sin^2 k_0 L}{1 - 2R\cos 2k_0 L + R^2}, \tag{14}$$

where $k_0=2\pi/\lambda$ is the free-space propagation constant, and R is the power reflection coefficient of each mirror.

While the quality factors of RF cavities can easily exceed $10^4$, such cavities are typically unloaded. In a magnetron, the relevant quality factor is the loaded quality factor $Q_L$, which includes not only the RF losses in the walls of the cavity but also takes into account the load placed on the cavity by the output coupler. The loaded quality factor $Q_L$ of a magnetron is usually much smaller than the unloaded Q, and is typically less than 500. The power reflection coefficient R accounts for both wall losses and output coupling, and will be chosen to yield $Q_L \approx 300$ for an empty cavity. The Q of an empty cavity is the resonant frequency divided by the bandwidth of the cavity, which yields $$Q_0 = \frac{\pi\sqrt{R}}{1 - R}. \tag{15}$$

For the plasma-loaded cavity, the cavity reflection coefficient is $$R_{loaded} = R\left|\frac{1 - \alpha e^{-2ik(L-d)}}{1 - R\alpha e^{-2ik(L-d)}}\right|, \tag{16}$$

where $$\alpha = -\frac{1}{\sqrt{R}}\frac{(1 - n_R + in_I)e^{(in_R+n_I)k_0 d} - \sqrt{R}(1 + n_R - in_I)e^{-(in_R+n_I)k_0 d}}{(1 + n_R - in_I)e^{(in_R+n_I)k_0 d} - \sqrt{R}(1 - n_R + in_I)e^{-(in_R+n_I)k_0 d}}. \tag{17}$$

For a cavity loaded by a collisional plasma 21 having L=20 cm, d=5 cm, R=0.99, $n_p=1.0\times10^{11}$ $cm^{-3}$, B=0, and $v_c=5.0\times10^7$ $s^{-1}$, the unloaded Q, obtained from Equation (15), is 312.6, and the loaded Q is 297. The loaded Q is greater than the unloaded Q if the collision frequency is somewhat lower. The reason for this is that the composite mirror consisting of the slab of plasma 21 and the partially reflecting mirror has a higher reflectivity than the mirror alone. The reflectivity exceeds that of the mirror alone for frequencies up to approximately 2.4 GHz, beyond which a resonance occurs near the plasma frequency, which in this case is 2.84 GHz.

From the above, it can be seen that the resonant frequency of a Fabry-Perot cavity can be tuned by nearly 20% by a slab of plasma 21 filling 25% of the cavity and having a density of only $1.0\times10^{11}$ $cm^{-3}$. Also, although the effect of a transverse DC magnetic field is detrimental to the tuning properties of the plasma 21, careful design of a plasma-tuned magnetron can minimize the flux density at the location of the plasma 21, mitigating the negative effect on the tuning range.

The effects of a collisional plasma 21 on the tuning properties of a resonant cavity reduce the Q of a cavity containing such a plasma 21. For a plasma density of $1.0\times10^{11}$ $cm^{-3}$ and a collision frequency of $5.0\times10^7$ $s^{-1}$, the Q of a 20 cm cavity is reduced from 312.6 to 297 when a slab of plasma 21 having a thickness of 5 cm is placed inside the cavity.

Thus, improved magnetron oscillators that are tuned using plasmas, and frequency tuning methods have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A magnetron oscillator comprising:

a magnetron tube comprising an anode having a plurality of inwardly protruding vanes and a central cathode, and wherein a plurality of resonant cavities are formed that are bounded by gaps between ends of adjacent vanes, walls of the inwardly protruding vanes and an adjacent portion of the wall of the anode;

means for supplying a bias voltage between the anode and central cathode to create a DC electric field therebetween;

means for applying a magnetic field along an axial direction of the magnetron tube; and one or more gas-filled subcells disposed within each of the plurality of resonant cavities; and a plasma formed within one or more selected subcells of each cavity which is controllable to alter the electromagnetic field within each cavity to tune the oscillating frequency of the magnetron oscillator.

2. The magnetron oscillator of claim 1 wherein the plasma comprises a low-density plasma wherein dielectric properties of the plasma change the effective volume of the resonant cavities in which the plasma is formed.

3. The magnetron oscillator of claim 1 wherein the plasma comprises a high-density plasma in which the plasma frequency is sufficiently high so that microwaves are reflected by the plasma.

4. The magnetron oscillator of claim 1 wherein the plasma comprises a magnetized collisional plasma.

5. The magnetron oscillator of claim 4 wherein the plasma comprises a high-density plasma in which the plasma frequency is sufficiently high so that microwaves are reflected by the plasma.

6. The magnetron oscillator of claim 4 wherein the plasma comprises a low-density plasma wherein dielectric properties of the plasma change the effective volume of the resonant cavities in which the plasma is formed.

7. In a magnetron oscillator comprising a magnetron tube having an anode with a plurality of inwardly protruding vanes and a cathode and wherein a plurality of resonant cavities are formed that are bounded by gaps between ends of adjacent vanes, walls of the inwardly protruding vanes and an adjacent portion of the wall of the anode, means for supplying a bias voltage between the anode and cathode to create a DC electric field therebetween, and means for applying a magnetic field along an axial direction of the magnetron tube, a method of frequency tuning the magnetron oscillator comprising the steps of:

disposing one or more gas-filled subcells within each of the plurality of resonant cavities; and forming a plasma within selected subcells of each resonant cavity to alter the electromagnetic field within each cavity to tune the oscillating frequency of the magnetron oscillator.

8. The method of claim 7 which comprises the step of forming a low-density plasma within one or more selected subcells of each resonant cavity wherein dielectric properties of the plasma change the effective volume of the resonant cavities in which the plasma is formed.

9. The method of claim 7 which comprises the step of forming a high-density plasma within one or more selected subcells of each cavity wherein the plasma frequency sufficiently high so that microwaves are reflected by the plasma.

10. The method of claim 7 which comprises the step of forming a magnetizeed collisional plasma within one or more selected subcells of each resonant cavity.

11. The method of claim 10 which comprises the step of forming a high-density plasma within one or more selected subcells of each resonant cavity in which the plasma frequency sufficiently high so that microwaves are reflected by the plasma.

12. The method of claim 10 which comprises the step of forming a low-density plasma within one or more selected subcells of each resonant cavity wherein dielectric properties of the plasma change the effective volume of the resonant cavities in which the plasma is formed.

* * * * *